US008292650B2

(12) United States Patent
Makino et al.

(10) Patent No.: US 8,292,650 B2
(45) Date of Patent: Oct. 23, 2012

(54) LEVER-TYPE CONNECTOR

(75) Inventors: Kenji Makino, Yokkaichi (JP); Wataru Shamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 93 days.

(21) Appl. No.: 12/951,689

(22) Filed: Nov. 22, 2010

(65) Prior Publication Data

US 2011/0130026 A1 Jun. 2, 2011

(30) Foreign Application Priority Data

Dec. 2, 2009 (JP) ..... 2009-274584

(51) Int. Cl.
*H01R 4/50* (2006.01)

(52) U.S. Cl. ..... 439/345

(58) Field of Classification Search ..... 439/345, 439/157, 352, 160, 372, 341
See application file for complete search history.

(56) References Cited

U.S. PATENT DOCUMENTS

| | | | | |
|---|---|---|---|---|
| 5,873,745 | A * | 2/1999 | Duclos et al. | 439/157 |
| 6,213,795 | B1 * | 4/2001 | Drescher et al. | 439/157 |
| 6,796,815 | B2 * | 9/2004 | Okabe et al. | 439/157 |
| 7,281,933 | B1 * | 10/2007 | Shigeta et al. | 439/157 |
| 7,311,535 | B2 * | 12/2007 | Taguchi et al. | 439/157 |
| 7,481,661 | B2 * | 1/2009 | Takahashi et al. | 439/157 |
| 7,670,159 | B2 | 3/2010 | Shamoto et al. | |
| 2007/0167046 | A1 | 7/2007 | Shigeta et al. | |
| 2007/0173091 | A1 | 7/2007 | Taguchi et al. | |
| 2007/0293071 | A1 | 12/2007 | Takahashi et al. | |
| 2008/0081498 | A1 | 4/2008 | Fukatsu et al. | |
| 2009/0170358 | A1 | 7/2009 | Shamoto et al. | |

FOREIGN PATENT DOCUMENTS

JP 2004288442 10/2004

* cited by examiner

*Primary Examiner* — Jean F Duverne

(74) *Attorney, Agent, or Firm* — Gerald E. Hespos; Michael J. Porco

(57) ABSTRACT

If connection postures of a first and a second housings (10, 40) are inclined from proper ones at a final stage of a connecting process of the first and second housings (10, 40,) pressing portions (73) of a lever (60) press pressable portions (29) of the first housing (10) to correct the connection postures of the first and second housings (10, 40). A mutual connection force of the first and second housings (10, 40) reaches a maximum value when an operable portion (61) of the lever (60) is located at a position near the rear surface of a cover (12) or overlapping the rear surface of the cover (12) before the pressing portions (73) press the pressable portions (29) in the connecting process of the first and second housings (10, 40).

9 Claims, 10 Drawing Sheets

LEVER-TYPE CONNECTOR

BACKGROUND OF THE INVENTION

1. Field of the Invention

The invention relates to a lever-type connector.

2. Description of the Related Art

U.S. Pat. No. 7,670,159 discloses a conventional lever-type connector with male and female housings that are connectable with each other. The male housing has projecting cam followers. The female housing has a housing main body and a cover (omitted in U.S. Pat. No. 7,670,159). A lever is mounted rotatably on an outer surface of the housing main body, and pressable portions are formed on the outer surface. Terminal fittings connected to ends of wires are accommodated in the housing main body, and the wires are drawn out to the outside through the rear surface of the housing main body. The drawn-out wires are bent in a direction intersecting with a connecting direction by the cover.

The lever has an operable portion and two arms projecting from the opposite ends of the operable portion to define a U-shape. The lever is mounted to straddle the cover. Each arm has a cam groove and a pressing portion. The lever is rotatable between an initial position where the operable portion is distant from the rear surface of the cover and a connection position where the operable portion is near the rear surface of the cover.

The two housings are fit lightly with the lever at the initial position so that the cam followers enter entrances of the cam grooves. The lever then is rotated toward the connection position. As a result, the cam followers slide on groove surfaces of the cam grooves to display a cam action that enables the two housings to be connected with a small connection force. The pressing portions press the pressable portions at a final stage of the connecting process if the housings are in inclined connection postures during the process of connecting the two housings, thereby eliminating a clearance between connection surfaces of the housings. As a result, the connection postures of the two housings are corrected.

A connection force resulting from resistance while connecting the two housings of the conventional lever-type connector gradually increases as a connection depth of the two housings increases, as shown in FIG. 10(*c*), and reaches a peak P3 when the lever is rotated halfway. The connection force then gradually decreases and reaches a peak P5. However, if the connection postures of the housings are inclined, a posture correction peak P4 resulting from the pressing of the pressable portions by the pressing portions is present before the locking peak P5. Thus, an operator might mistakenly perceive the posture correction peak P4 as the locking peak P5 and end a connecting operation of the two housings halfway. Such an erroneous connection of the two housings is likely to occur in a situation where the connecting operation of the two housings has to be performed in a blind manner.

The present invention was developed in view of the above situation and an object thereof is to prevent erroneous connection of housings.

SUMMARY OF THE INVENTION

The invention relates to a lever-type connector with a first housing, a second housing that is connectable with the first housing and a lever mounted on the first housing. The lever has a cam receiving portion and an operable portion. The operable portion is distant from a specified portion of the first housing when the lever is at an initial position. However, the operable portion is near the specified portion of the first housing when the lever is displaced to a connection position. The second housing has a cam that can be engaged with the cam receiving portion. A cam action is displayed between the cam and the first housing by displacing the lever from the initial position toward the connection position while the cam is engaged with the cam receiving portion of the lever. The cam action causes the first and second housings to be connected with each other. At least one pressing portion is formed on the lever and presses at least one pressable portion on the first housing if the first and second housings are inclined from proper connection postures at a final stage of a connecting process so that the connection postures of the first and second housings are corrected. A mutual connection force of the first and second housings reaches a maximum value when the operable portion is near the specified portion of the first housing or overlapping the specified portion of the first housing before the pressing portion presses the pressable portion in the connecting process.

The mutual connection force of the two housings reaches the maximum value at a stage immediately before the final stage. Thus, the two housings can be brought to a proper connection position at once by an operating force exerted up to the stage where the maximum value is reached even if the connection postures of the housings are inclined from the proper postures and a posture correction peak resulting from the pressing of the pressable portion by the pressing portion appears at the final stage of the connection.

The first housing preferably has a housing main body and wires are drawn out through the rear surface of the housing main body. A cover is mounted on the housing main body and bends the wires in a specified direction. A mutual connection force of the first and second housings reaches a maximum value when the operable portion of the lever preferably is near the rear surface of the cover or overlaps the rear surface of the cover before the pressing portion presses the pressable portion in the connecting process of the first and second housings.

The connection force reaches the maximum value when the operable portion of the lever reaches the position near the rear surface of the cover or overlapping the rear surface of the cover. Therefore, the position where the connection force reaches the maximum value can be recognized easily even if an operator performs a connecting operation of the housings in a blind manner. Therefore, erroneous connection of the housings can be prevented.

The operable portion preferably extends in a direction intersecting the specified portion of the first housing, which preferably is the rear surface of the cover. Additionally, the operable portion preferably is inclined to face a direction opposite to an operating direction when the mutual connection force of the housings reaches the maximum value. Thus, an operating force on the operable portion is exerted more easily and an erroneous connection of the housings can be prevented more reliably.

At least one restricting piece preferably projects from the lever to prevent wires from sticking out when the lever is at the initial position in a state where the cover is not mounted.

At least one groove preferably is formed in the lever adjacent to the restricting piece. The groove extends in substantially forward and backward directions at the connection position and forms an opening at the front edge of the lever. The back end of the groove may function as the pressing portion.

At least one resiliently deformable lock preferably is provided on the lever. The lock engages one or more interlocking portions when the housings are connected properly connected. Thus, the lever is held at the connection position and the first and second housings are held in a connected state. The lock extends in substantially forward and backward directions at the connection position and a free end of the lock is covered at least partly by a protection wall to prevent inadvertent unlocking.

One or more erroneous assembling preventing projections are formed on the housing main body. The projections fit into respective recesses in inner surfaces of a mating receptacle of the second housing if the housings are oriented properly so that a connecting operation of the housings proceeds. However, the projections contact the second housing if one of the housings is oriented improperly to prevent the connecting operation of the first and second housings.

These and other objects, features and advantages of the invention will become more apparent upon reading the following detailed description of preferred embodiments and accompanying drawings.

DETAILED DESCRIPTION OF THE PREFERRED EMBODIMENTS

A lever-type connector according to the invention is illustrated in FIGS. 1 to 10 and has a first housing 10, a second housing 40 connectable with the first housing 10 and a lever 60 mounted on the first housing 10. In the following description, ends of the two housings 10, 40 to be connected with each other are referred to as front ends.

Figure 6:
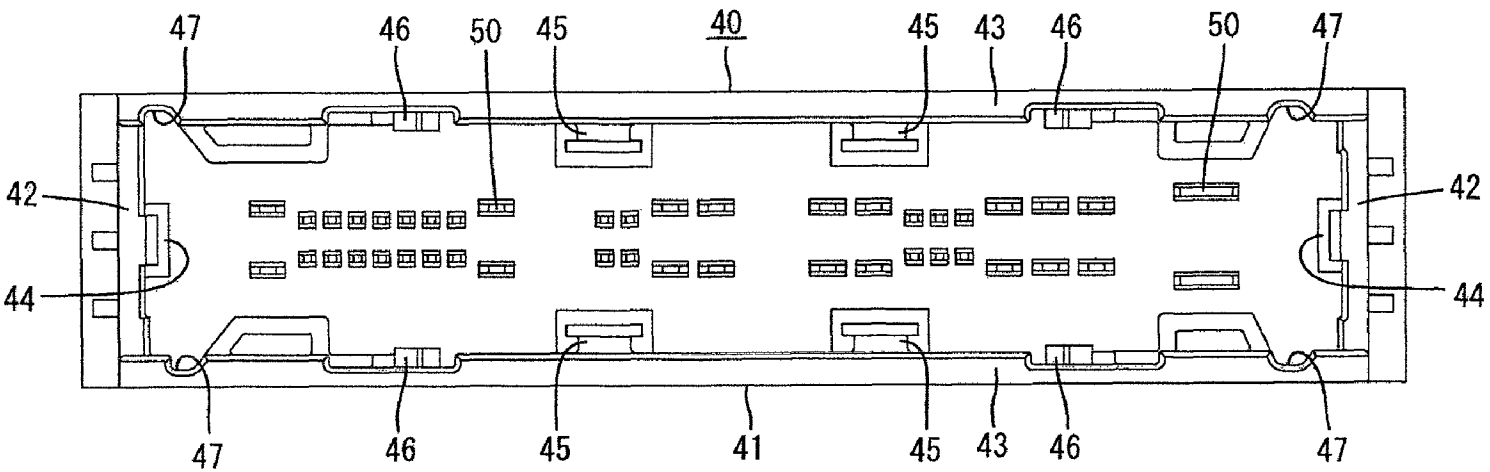
FIG. 6 is a front view of a second housing.

The second housing 40 is made e.g. of synthetic resin and is formed as a male housing. The second housing 40 includes a wide rectangular tubular receptacle 41 and tabs 50 of male terminal fittings project into the receptacle 41. As shown in FIG. 6, the receptacle 41 has opposite short-sides 42 that are short in a height direction, and opposite long-sides 43 that are long in the width direction. Left and right interlocking portions 44 project at the front ends of the inner surfaces of the short-sides 42 of the second housing 40. Left and right cylindrical cam followers 45 project from the inner surfaces of the long-sides 43 of the second housing 40. The cam followers 45 are arranged at the opposite sides of the widthwise center of each long-side 43. Unlocking portions 46 are formed at the back sides of the inner surfaces of the long-side portions 43.

Figure 1:
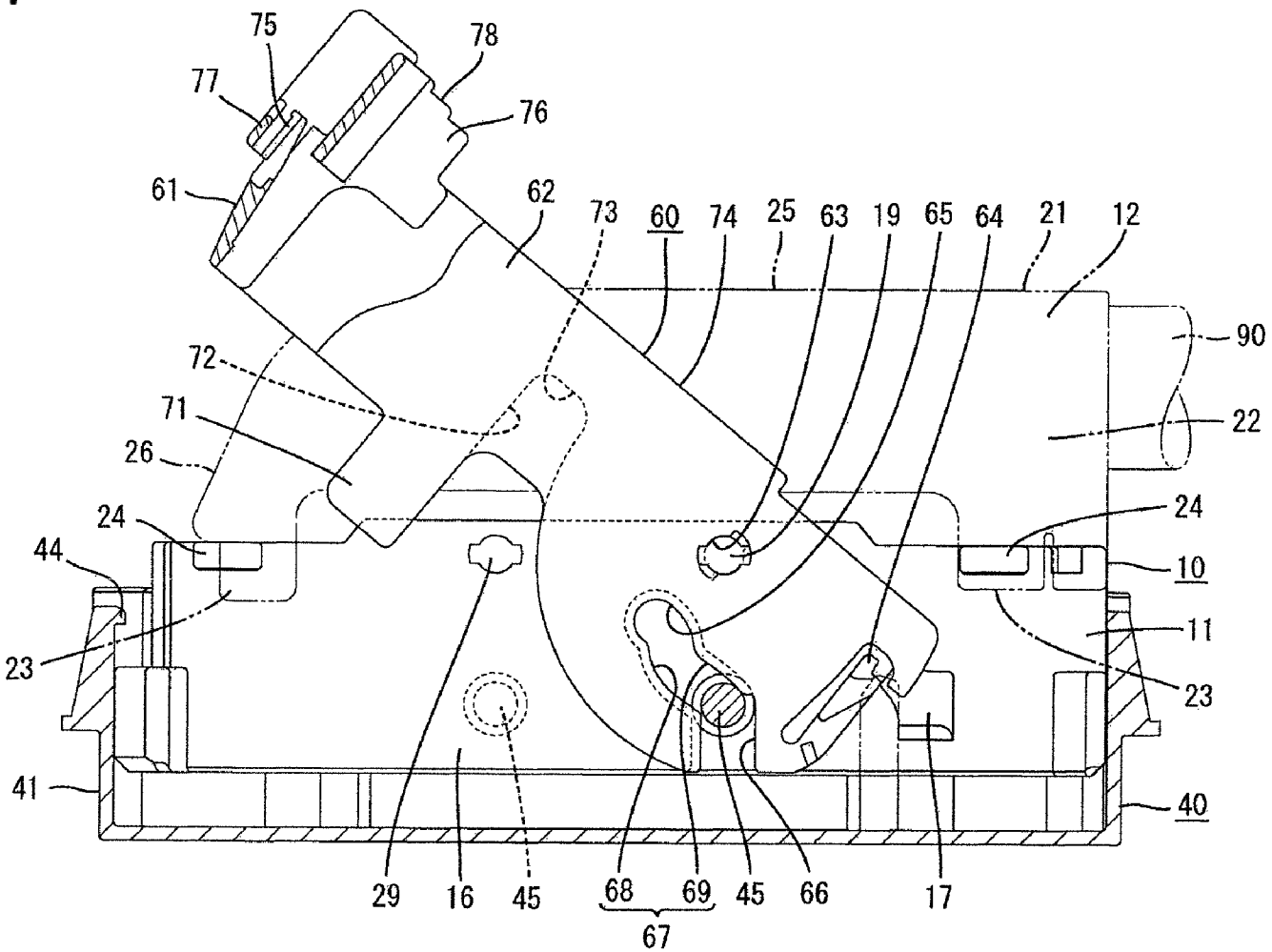
FIG. 1 is a plan view partly in section of a lever-type connector of the invention showing a state where two housings are fit lightly with a lever at an initial position.
Figure 5:
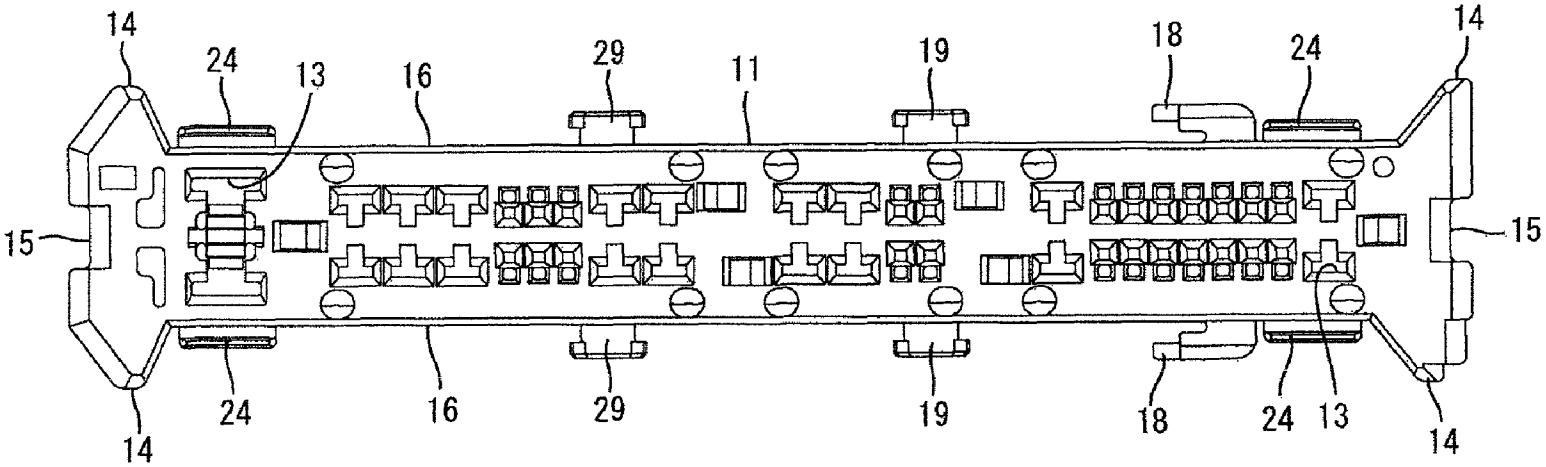
FIG. 5 is a front view of a housing main body.

The first housing 10 is made e.g. of synthetic resin and is formed as a female housing. As shown in FIG. 1, this first housing 10 has a wide rectangular block-shaped main body 11 and a wide cover 12 is mounted on the housing main body 11 to at least partly cover the rear surface of the main body 11. As shown in FIG. 5, the housing main body 11 is formed with cavities 13 and unillustrated female terminal fittings are inserted into the respective cavities 13 from behind. The female terminal fittings are connected to ends of wires 90, and the wires 90 are drawn out through the rear surface of the main body 11. Erroneous assembling preventing projections 14 are formed at four corners of the main body 11. The projections 14 fit into respective recesses 47 in inner surfaces of the mating receptacle 41 if the housings 10, 40 are oriented and positioned properly so that a connecting operation of the two housings 10, 40 proceeds. On the other hand, the projections 14 contact the front edge of the receptacle 41 if one of the housings 10, 40 is oriented improperly, such as in a vertically inverted posture, to prevent the connecting operation of the two housings 10, 40.

The main body 11 has opposite short-side surfaces 15 that extend in the height direction and long-side surfaces 16 that extend in the width direction. Two partial engaging portions 17 are formed on the long-side surfaces 16 of the main body 11 at one widthwise side and are engageable with the respective partial locks 64. Each partial engaging portion 17 includes a projecting piece 18 facing an outer surface of the main body 11 with a clearance defined therebetween. A supporting shaft 19 and a pressable portion 29 project from a rear end portion of each long-side surface 16 of the main body 11. The supporting shafts 19 are arranged at the right side and the pressable portions 29 are arranged at the left side in the shown example. The supporting shafts 19 and the pressable portions 29 are shaped and sized substantially identically and are arranged substantially side by side on the same axes extending in forward and backward directions as the respective cam followers 45. The lever 60 is supported rotatably on the supporting shafts 19.

Figure 7:
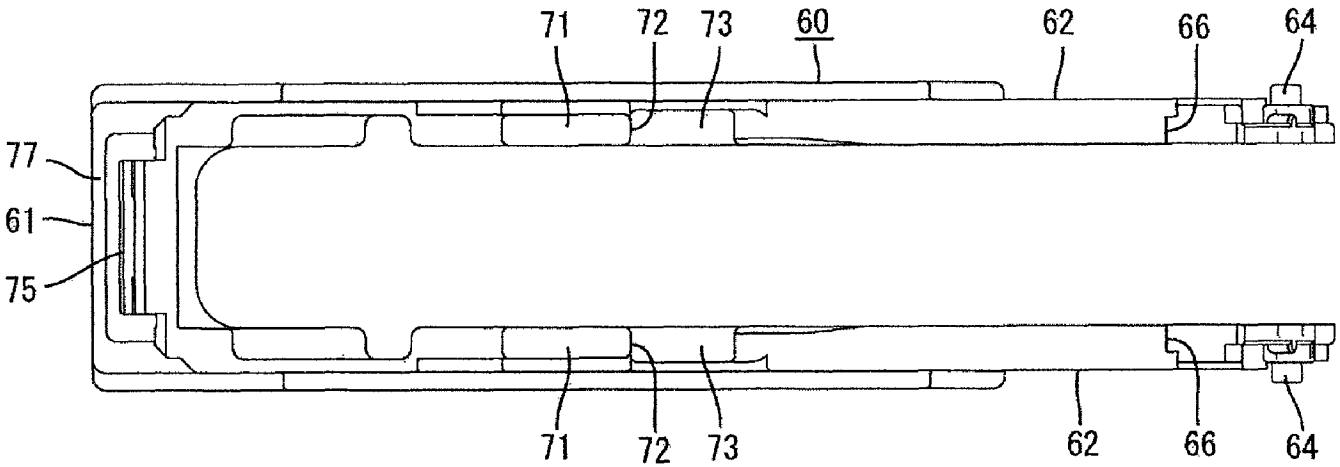
FIG. 7 is a front view of the lever.

The lever 60 is made e.g. of synthetic resin and includes an operable portion 61 Two substantially parallel arms 62 project from opposite ends of the operable portion 61 with respect to the height direction. Thus, the lever 60 is substantially U-shaped, as shown in FIG. 7. Each arm 62 has a bearing hole 63, and the lever 60 is mounted on the first housing 10 for rotation between an initial position IP and a connection position CP by fitting the supporting shafts 19 into the bearing holes 63. At the initial position IP, the arms 62 project back from the rear surface of the cover 12 and the operable portion 61 is distant from the rear surface of the cover 12 (see FIG. 1). On the other hand, at the connection position CP, the arms 62 are at outer sides of the cover 12 and the operable portion 61 is arranged near and along the rear surface of the cover 12 (see FIG. 4).

As shown in FIG. 1, two resiliently deformable partial locks 64 are formed on and along the outer peripheral edges of the arms 62. The partial locks 64 are resiliently engageable with the projecting pieces 18 of the partial engaging portions 17 at the initial position IP to prevent rotation of the lever 60 toward the connection position CP of the two housings 10, 40. On the other hand, when the two housings 10, 40 are fit lightly, the partial locks 64 contact the unlocking portions 46 of the mating receptacle 41 and disengage from the partial engaging portions 17, thereby permitting the rotation of the lever 60 toward the connection position CP of the two housings 10, 40.

Cam grooves 65 penetrate the arms 62 in a thickness direction and engage the mating cam followers 45 when the housings 10, 40 are connected. Specifically, each cam groove 65 has an introducing groove 66 and an action groove 67. The introducing groove 66 extends in forward and backward directions at the initial position and forms an opening at the front edge of the corresponding arm 62. The action groove 67 extends in a curved manner from the back end of the introducing groove 66. The front edge of the action groove 67 defines a connection cam surface 68 on which the cam follower 45 slides when connecting the housings 10, 40, and the rear edge defines a separation cam surface 69 on which the cam follower 45 slides when separating the housings 10, 40. The connection and separation cam surfaces 68 and 69 are substantially parallel and are formed so that radii of curvatures are smaller at a final stage of the connecting process.

Two restricting pieces 71 project from the front ends of the arms 62. The restricting pieces 71 prevent the wires 90 from sticking out when the lever 60 is at the initial position IP in a state where the cover 12 is not mounted. Bottomed recessed grooves 72 are formed in the inner surfaces of the both arm portions 62 adjacent to the respective restricting pieces 71. The recessed grooves 72 extend substantially in forward and backward directions at the connection position CP and form openings at the front edges of the arms 62. The back ends of the recessed grooves 72 define pressing portions 73 that can contact the pressable portions 29. The pressing portions 73 contact the pressable portions 29 and press the pressable portions 29 forward if the housings 10, 40 are inclined from their proper connection postures at the final stage of the connecting process and/or if a clearance larger than a permissible size is formed between the other widthwise side of the front surface of the housing main body 11 and the other widthwise side of the back surface of the receptacle 41. Thus, the clearance is eliminated or reduced and the connection postures of the housings 10, 40 are corrected.

The rear edges of the arms 62 have substantially straight edges 74 that are substantially parallel to the rear edge of the housing main body 11 when the lever 60 is at the connection position CP. The operable portion 61 of the lever 60 includes a resiliently deformable lock 75 particularly located between the both arms 62 and a main portion 76 projecting back from the straight edges 74. The lock 75 is substantially in the form of an arm projecting back from the front end of the lever 60. The lock 75 engages the interlocking portions 44 when the housings 10, 40 are connected properly connected. Thus, the lever 60 is held at the connection position CP and the housings 10, 40 are held inseparably. The lock 75 extends in forward and backward directions at the connection position (see FIG. 4). A free end of the lock 75 is covered by a protection wall 77 to prevent inadvertent unlocking of the lock 75.

The main portion 76 becomes gradually thicker with increasing distance from the bearing holes 63 and inclines with respect to the straight edges 74. The upper surface of the main portion 76 defines a stepped operating surface 78 on which fingers of an operator are placed to press the main portion 76 when the lever 60 is rotated from the initial position IP to the connection position CP.

The cover 12 is made e.g. of synthetic resin and includes a back wall 21 that faces the rear surface of the housing main body 11 and two side plates 22 that project forward from opposite ends of the back wall 21 with respect to the height direction. One widthwise end surface of the cover 12 is open, and the wires 90 can be drawn out through this opening in a direction substantially orthogonal to the connecting direction. Left and right lock pieces 23 project forward from opposite widthwise ends of the front edge of each side plate 22. The lock pieces 23 engage respective lock piece receiving portions 24 at the rear ends of the long-side surfaces 16 of the main body 11 to hold the cover 12 on the main body 11.

The back wall 21 includes rear plate 25 to be arranged substantially parallel to the rear surface of the housing main body 11 and a curved end plate 26 at least partly closing the other widthwise side of the cover 12. The operable portion 61 of the lever 60 is to be displaced substantially along the outer surface of the end plate 26 at the final stage of the connecting process of the housings 10, 40 and faces the end surface 26 in the width direction in a properly connected state of the two housings 10, 40.

Figure 2:
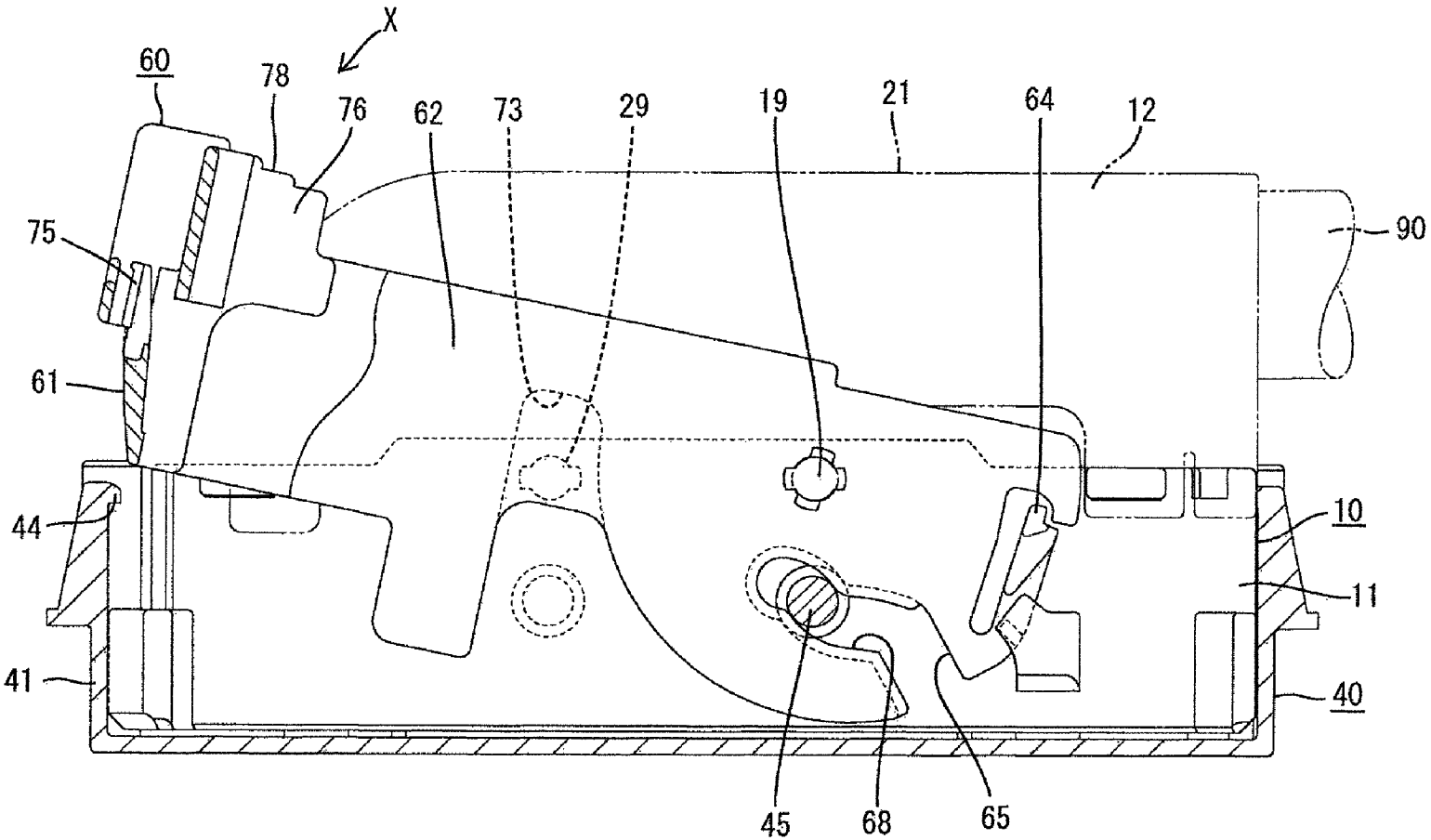
FIG. 2 is a plan view partly in section showing a state where a connection force of the two housings reaches a maximum in a connecting process of the two housings.
Figure 3:
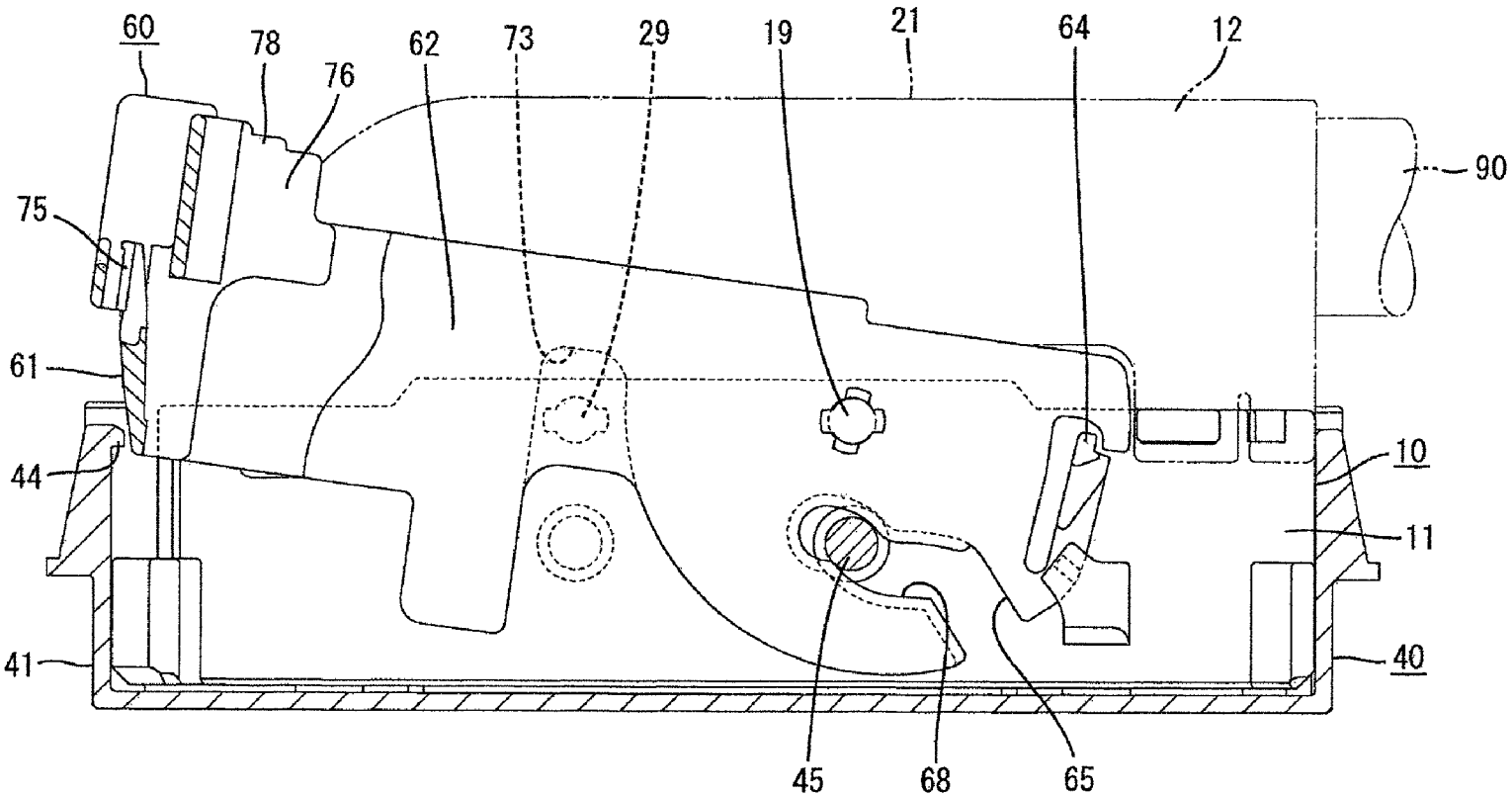
FIG. 3 is a plan view partly in section showing a state slightly beyond the state where the connection force of the two housings reaches the maximum value in the connecting process of the two housings.
Figure 4:
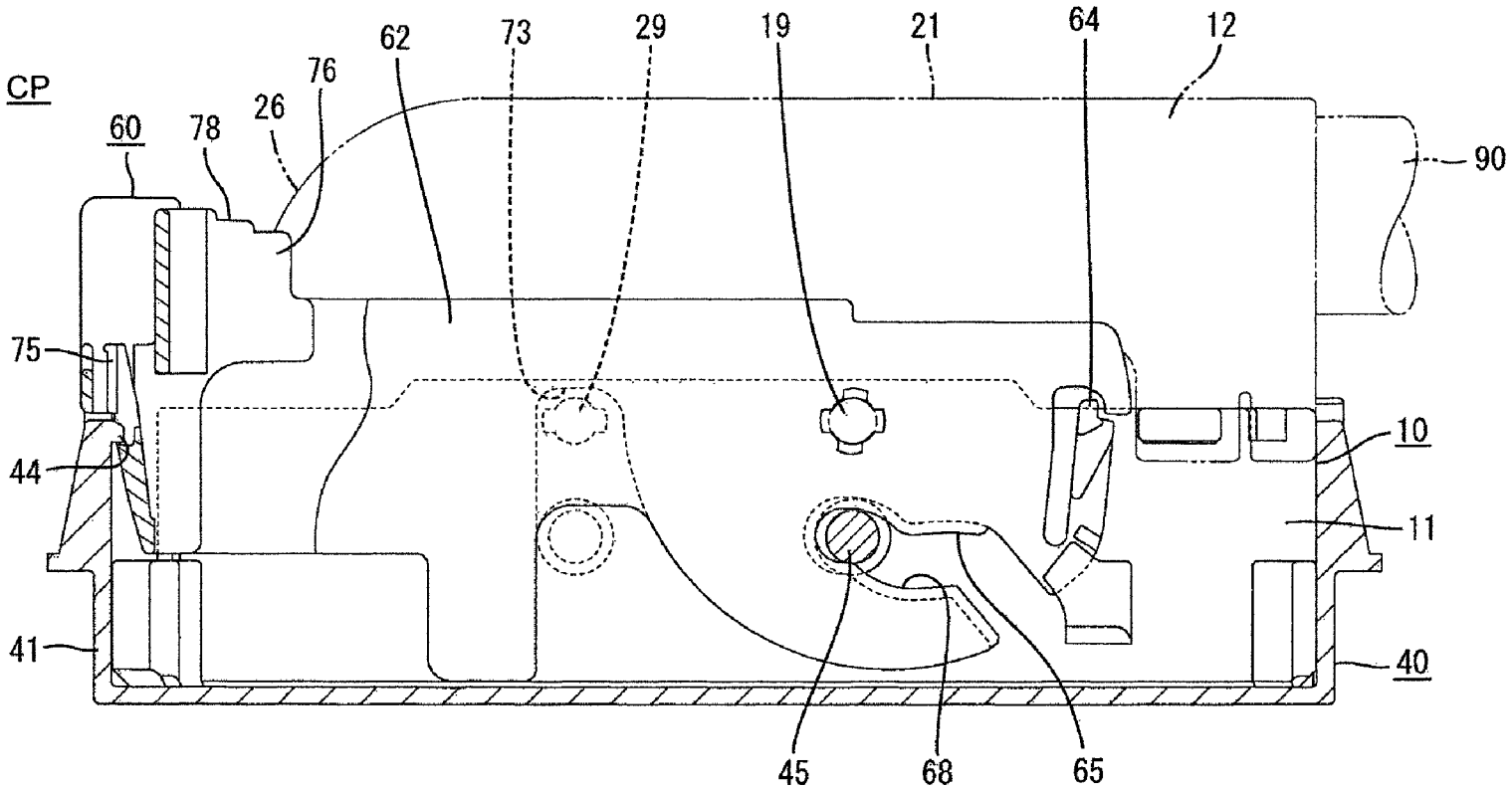
FIG. 4 is a plan view partly in section showing a state where the two housings are properly connected.

The two housings 10, 40 are held opposite to each other with the lever 60 at the initial position IP to start the connection of the housings 10, 40. The cam followers 45 enter the introducing grooves 66 of the cam grooves 65 at the initial stage of the connecting operation, and the unlocking portions 46 contact with the partial locks 64 to release the lever 60 from its partly locked state. The lever 60 then is rotated toward the connection position CP. Thus, the cam followers 45 slide on the connection cam surfaces 68 of the cam grooves 65 and display a cam action that causes the connecting operation of the housings 10, 40 to progress. The main portion 76 of the lever 60 is near the outer surface of the end plate 26 of the cover 12 when the cam followers 45 reach positions where the curvatures of the connection cam surfaces 68 change at the final stage of the connecting process, as shown in FIG. 2. More particularly, the main portion 76 of the lever 60 is at substantially the same height as the rear surface of the cover 12 and at least partly overlaps the rear surface of the cover 12 when the cam followers 45 reach positions where the curvatures of the connection cam surfaces 68 change at the final stage of the connecting process shown in FIG. 2. At this time, the operating surface 78 of the main portion 76 extends in a direction intersecting the rear surface of the cover 12 and is inclined to face in a direction opposite to an operating direction X. Additionally, a connection force of the two housings 10, 40 reaches a connection peak P1 to take a maximum value (see FIG. 10(*a*)). A posture correction peak P2 is included in FIG. 10(*a*), but is not displayed if the housings 10, 40 are kept in their proper connection postures. The connection force of the housings 10, 40 increases substantially linearly from the start of the connecting operation housings 10, 40 to a point at which the connection force reaches the maximum value.

The lock 75 resiliently engages the interlocking portions 44 when the main portion 76 reaches the connection position behind the other widthwise end of the cover 12. As a result the two housings 10, 40 are held in their properly connected state. At this time, the cam followers 45 are at the back ends of the cam grooves 65.

Figure 8:
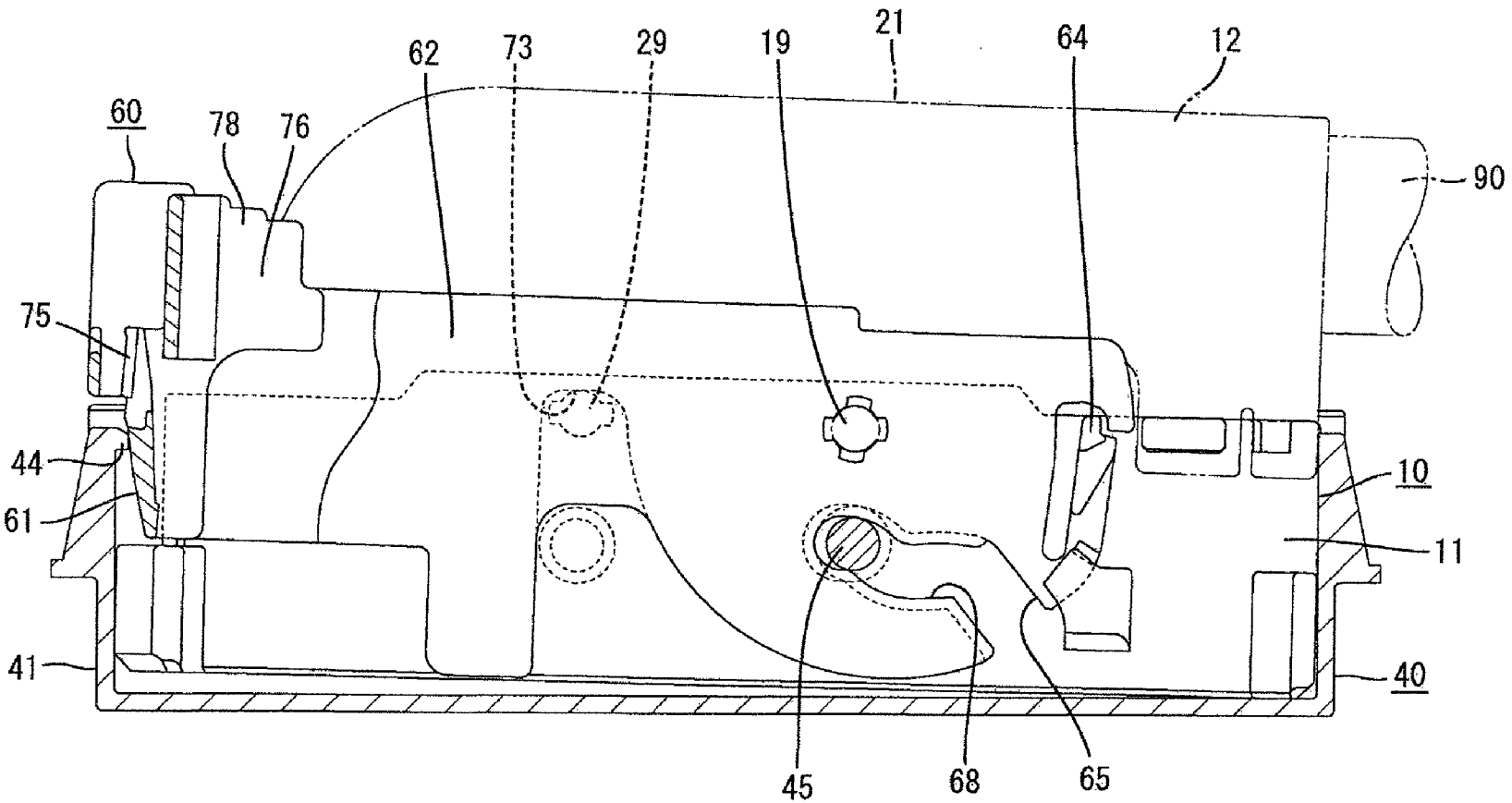
FIG. 8 is a plan view partly in section showing a state where the housings are inclined from proper connection postures and pressing portions press pressable portions.
Figure 9:
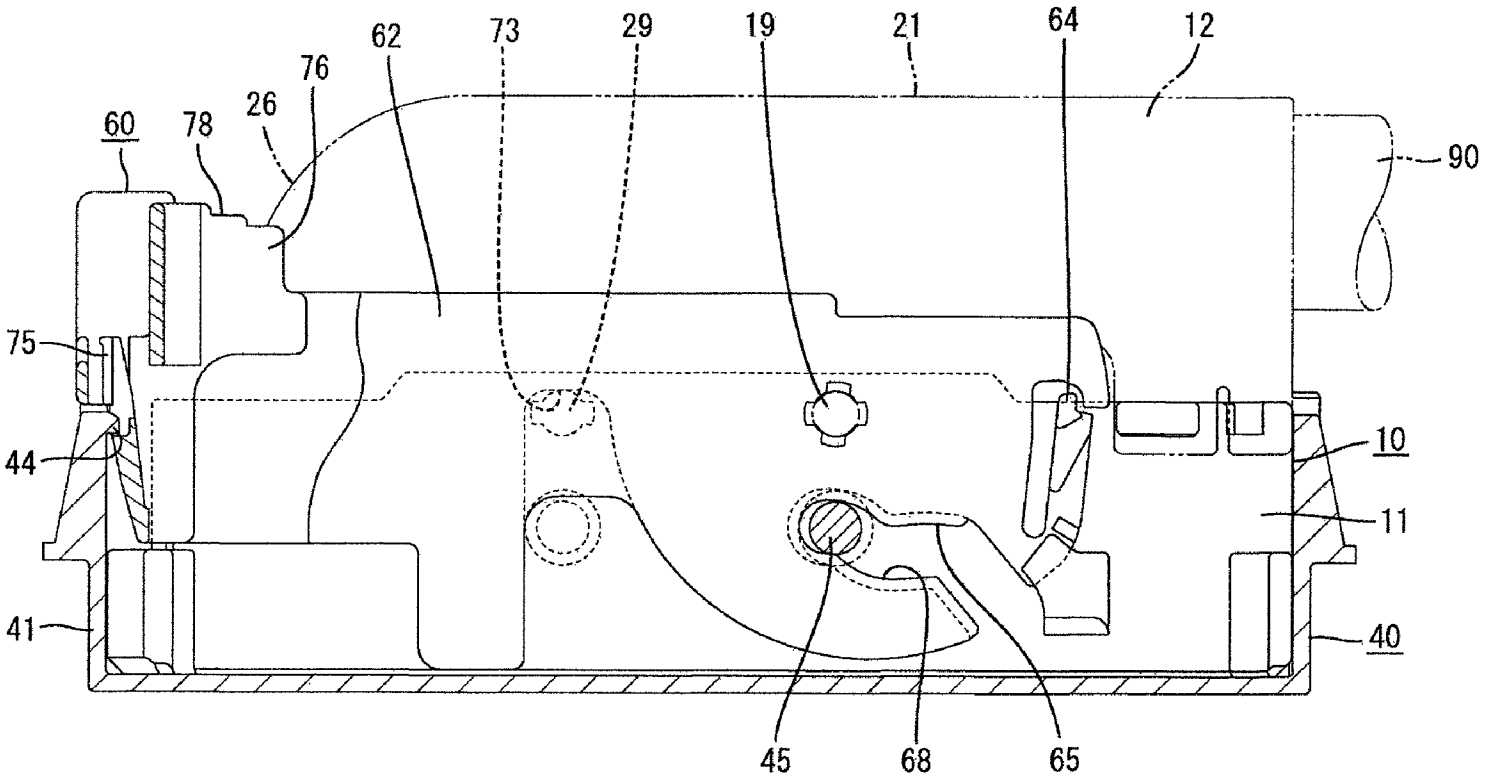
FIG. 9 is a plan view partly in section showing a state where the two housings are properly connected while the pressing portions are pressing the pressable portions.

The pressing portions 73 do not contact with the pressable portions 29 if the two housings 10, 40 are in their proper connection postures, as in the above case. However, the two housings 10, 40 may incline from their proper connection postures so that the first housing 10 is distanced from the second housing 40 at the other widthwise side. Thus, the pressing portions 73 contact the pressable portions 29 and press the pressable portions 29 forward, as shown in FIG. 8, after the connection force of the housings 10, 40 reaches the connection peak P1 to take the maximum value and immediately before the two housings 10, 40 are connected properly. Then, a clearance between the other widthwise side of the front surface of the housing main body 11 and the other widthwise side of the back surface of the receptacle 41 substantially is eliminated to correct the connection postures of the housings 10, 40. The connection force of the two housings 10, 40 increases to display the posture correction peak P2 shown in FIGS. 10(*a*) and 10(*b*) as the pressing portions 73 press the pressable portions 29. However, the posture correction peak P2 is located near the connection peak P1 and inertia from the connection peak P1 acts so that the lever 60 can reach the connection position without the operator perceiving the posture correction peak P2.

Figure 10A:
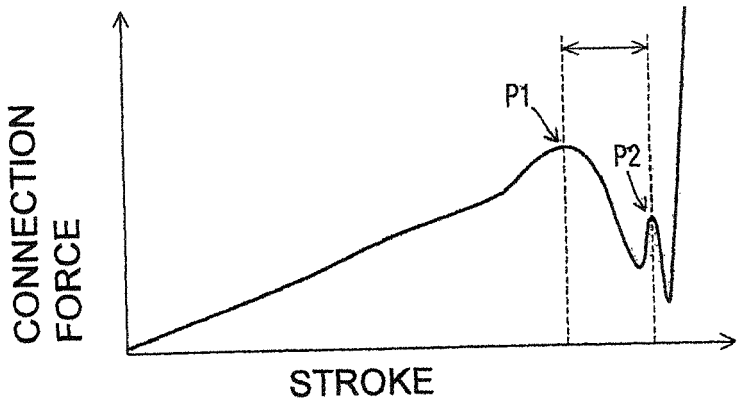
FIG. 10 are graphs showing a relationship between a stroke and a connection force.
Figure 10B:
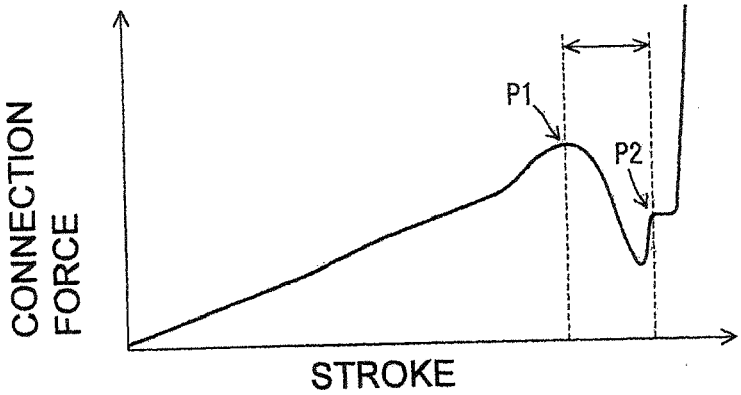
Figure 10C:
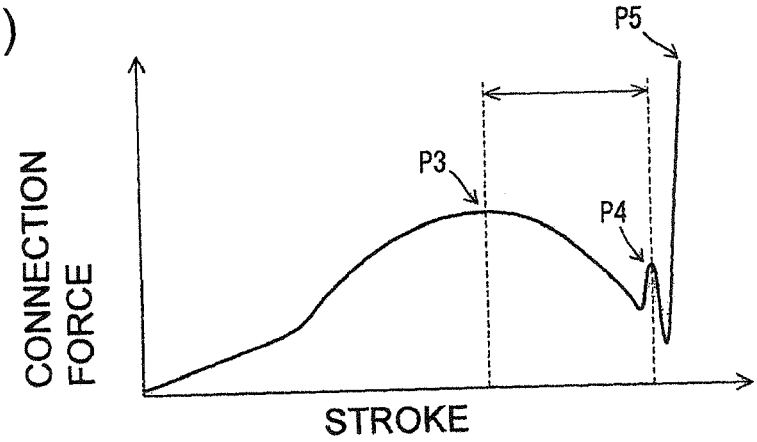
FIG. 10(C) PRIOR ART

FIG. 10(*b*) shows a mode in which the pressing portions 73 contact the pressable portions 29. In this case, the lever 60 reaches the connection position CP and the housings 10, 40 reach the properly connected state while the pressing portions 73 keep pressing the pressable portions 29. In contrast, FIG. 10(*a*) also shows a mode in which the pressing portions 73 contact with the pressable portions 29. However, in this case, the lever 60 reaches the connection position CP and the two housings 10, 40 reach the properly connected state with clearances formed between the pressing portions 73 and pressable portions 29 due to a deformation restoring force. Thus, there is shown either a mode of FIG. 9 in which the housings 10, 40 are connected properly with the pressing portions 73 and the pressable portions 29 kept in contact after being inclined from the proper connection postures or a mode shown in FIG. 4 in which the housings 10, 40 are connected properly with clearances formed between the pressing portions 73 and the pressable portions 29 after being inclined from the proper connection postures or while being kept in the proper connection postures.

As described above, the posture correction peak P2 appears at the final stage of the connecting process due to the pressing portions 73 pressing the pressable portions 29 if the connection postures of the housings 10, 40 are inclined. Thus, the two housings 10, 40 can be brought to the proper connection position at once by an operating force exerted up to the connection peak P1 since the connection force of the two housings 10, 40 reaches the maximum value and displays the connection peak P1 immediately before the appearance of the posture correction peak P2. More particularly, since the connection peak P1 is reached when the operable portion 61 of the lever 60 reaches the position overlapping the rear surface of the cover 12, the connection peak P1 can be recognized more easily even if the operator performs the connecting operation of the two housings 10, 40 in a blind manner. Therefore, erroneous connection of the housings 10, 40 can be prevented.

Further, since the operable portion 61 is arranged to substantially extend in the direction intersecting with the rear surface of the cover 12 and inclined to face in the direction opposite to the operating direction X when the mutual connection force of the two housings 10, 40 reaches the maximum value, it is easier to exert an operating force to the operable portion 61. Therefore, erroneous connection of the two housings 10, 40 can be prevented more reliably.

The present invention is not limited to the above described and illustrated embodiment. For example, the following embodiments are also included in the technical scope of the present invention.

The connection force of the two housings may reach a maximum value when the operable portion reaches a position near the rear surface of the cover in the connecting process of the two housings.

The lever may be rotatably or pivotably supported on the cover.

The lever may be composed of an operable portion and a single plate-like arm portion.

The draw-out direction of the wires from the cover is arbitrary.

The lever may be displaced along any other path different from an arc-shaped or circular one such as substantially along an elliptic or linear path.

What is claimed is:

1. A lever-type connector, comprising:

a first housing and a second housing connectable with each other, and a lever, wherein:

the first housing includes a main body and has the lever mounted on an outer surface thereof, the lever includes a cam receiving portion and an operable portion, the cam receiving portion having an introducing groove extending in substantially forward and backward directions from an initial position and a connection cam surface extending in a substantially curved manner from the back end of the introducing groove and in which a radius of curvature is smaller at a final stage than at an initial stage of the connecting process, the lever being displaceable between an initial position where the operable portion is distant from a specified portion of the first housing and a connection position where the operable portion is near the specified portion of the first housing, the second housing includes a cam, a cam action is displayed between the cam and the first housing by displacing the lever from the initial position toward the connection position with the cam engaged with the cam receiving portion so that the first and second housings are connected with each other, and at least one pressing portion formed on the lever presses at least one pressable portion formed on the first housing only if the first and second housings are inclined from proper connection postures thereof at a final stage of a connecting process, whereby the connection postures of the first and second housings substantially are corrected, wherein the connection cam surface is configured so that a connection force of the first and second housings reaches a maximum value when the cam reaches a final position at the connection cam surface and when the operable portion is at a position near the specified portion of the first housing or overlapping the specified portion of the first housing and substantially immediately before the pressing portion presses the pressable portion in the connecting process of the first and second housings so that inertia generated to overcome the maximum value of the connection force carries the lever to the connection position without an operator perceiving forces for correcting connection postures of first and second housings.

2. The lever-type connector of claim 1, wherein wires are drawn out through a rear surface of the housing main body, and a cover is mounted on the housing main body to at least partly cover a surface of the housing main body and bend the wires in a specified direction.

3. The lever-type connector of claim 1, wherein the operable portion extends in a direction intersecting with the specified portion of the first housing and is inclined to substantially face in a direction opposite to an operating direction when the mutual connection force of the first and second housings reaches the maximum value.

4. The lever-type connector of claim 1, wherein at least one restricting piece projects from the lever to prevent wires from sticking out when the lever is at the initial position.

5. The lever-type connector of claim 4, wherein at least one groove is formed in the lever adjacent to the restricting piece, the groove extends substantially in forward and backward directions at the connection position and forms an opening at the front edge of the lever and wherein the pressing portion is at a back end of the groove.

6. The lever-type connector of claim 1, wherein at least one resiliently deformable lock is provided on the lever, the lock engaging at least one interlocking portion when the first and second housings, are connected properly for holding the lever at the connection position.

7. The lever-type connector of claim 6, wherein the lock extends substantially in forward and backward directions at the connection position and a free end portion of the lock is covered at least partly by a protection wall for preventing inadvertent unlocking of the lock.

8. The lever-type connector of claim 1, further comprising erroneous assembling preventing projections on the main body, the projections being fit into respective recesses formed in inner surfaces of a mating receptacle of the second housing if the first and second housings, are positioned right opposite to each other so that a connecting operation of the first and second housings proceeds, the respective projections contacting the second housing if one of the first and second housings is oriented improperly to prevent the connecting operation of the first and second housings.

9. A lever-type connector, comprising:

a first housing having a main body and at least one pressable portion;

a second housing connectable with the first housing along a connecting direction and a cam formed on the second housing;

a lever mounted on the first housing and being displaceable between an initial position and a connection position, the lever having a cam receiving portion engageable with the cam for displaying a cam action to move the first and second housings along the connecting direction and into connection as the lever is displaced from the initial position toward the connection position, the cam receiving portion including a connection cam surface extending in a substantially curved manner and being configured so that a connection force increases substantially linearly and reaches a maximum value substantially immediately before the first and second housings are connected completely, the lever having at least one pressing portion disposed for pressing the pressable portion on the first housing at a final stage of a connecting process only if the first and second housings are inclined from a proper connection posture, the pressing portion and the pressable portion being disposed to engage substantially immediately after the connection force reaches the maximum value so that inertia generated to overcome the maximum value of the connection force carries the lever to the connection position without an operator perceiving forces for correcting connection postures of first and second housings.

* * * * *